US005713441A

United States Patent [19]

Chen

[11] Patent Number: 5,713,441

[45] Date of Patent: Feb. 3, 1998

[54] ROTATABLE HANDLE DEVICE

[76] Inventor: Lien-Ti Chen, 58, Ma Yuan West St., Taichung, Taiwan

[21] Appl. No.: 718,802

[22] Filed: Sep. 24, 1996

[51] Int. Cl.[6] ..... A45C 13/04; A45C 13/26

[52] U.S. Cl. ..... 190/115; 16/115

[58] Field of Search ..... 190/115, 18 A; 16/115

[56] References Cited

U.S. PATENT DOCUMENTS

| | | | |
|---|---|---|---|
| 3,513,952 | 5/1970 | Warner, Jr. | 16/115 |
| 5,464,081 | 11/1995 | Zwanzig | 190/115 |
| 5,497,865 | 3/1996 | Yun-Pi | 190/115 |

*Primary Examiner*—Jes F. Pascua

[57] ABSTRACT

A suitcase comprises two hollow fixed frames and a rotatable handle device. The rotatable handle device has a handle, two elongated arms, and two slide seats. Two protruded blocks are disposed on the corresponding slide seats. A plurality of fins are disposed on the corresponding first elongated arm to enclose an upper portion of the corresponding slide seats. Two longitudinal rods are inserted in the corresponding elongated arms. A transverse rod is disposed under the handle. Two opposite ends of the transverse rod are connected to the corresponding longitudinal rods. A spring is disposed between the handle and the transverse rod. A push button is disposed on the transverse rod to contact the spring.

6 Claims, 4 Drawing Sheets

ROTATABLE HANDLE DEVICE

BACKGROUND OF THE INVENTION

The invention relates to a rotatable handle device. More particularly, the invention relates to a rotatable handle device for a suitcase.

A conventional suitcase has a tractile bracket at the back of the suitcase. The tractile bracket has an inner sleeve and an outer sleeve. However, the conventional tractile bracket of the suitcase cannot be rotated at all.

SUMMARY OF THE INVENTION

An object of the present invention is to provide a rotatable handle device for a suitcase so that the rotatable handle device can be rotated easily.

Accordingly, a suitcase comprises a first and second hollow fixed frames disposed on a top of the suitcase. A rotatable handle device has a handle, a first and second elongated arms extending downward from the handle, a first slide seat disposed in the first hollow fixed frame, and a second slide seat disposed in the second hollow fixed frame. A first protruded block is disposed on an upper portion of the first slide seat. A second protruded block is disposed on an upper portion of the second slide seat. A first pair of fins are disposed on a lower end of the first elongated arm to enclose an upper portion of the first slide seat. The first pair of fins and the first protruded block are fastened by a first pivot pin. A second pair of fins are disposed on a lower end of the second elongated arm to enclose an upper portion of the second slide seat. The second pair of fins and the second protruded block are fastened by a second pivot pin. At least a pair of first grooves are formed on the first protruded block. At least a pair of second grooves are formed on the second protruded block. A first longitudinal rod is inserted in the first elongated arm. A second longitudinal rod is inserted in the second elongated arm. A transverse rod is disposed under the handle. A first end of the transverse rod is connected to an upper end of the first longitudinal rod. A second end of the transverse rod is connected to an upper end of the second longitudinal rod. An elastic element is disposed between the handle and the transverse rod. A push button is disposed on the transverse rod to contact the elastic element. A lower end of the first longitudinal rod is inserted in one of the first groove. A lower end of the second longitudinal rod is inserted in one of the first groove.

The spring presses the transverse rod downward. The first longitudinal rod is driven downward so that the lower end of the first longitudinal rod is inserted in the first groove. The second longitudinal rod is driven downward so that the lower end of the second longitudinal rod is inserted in the second groove.

The push button is pressed upward so that the first and second longitudinal rods are driven upward. The lower end of the first longitudinal rod disengages from the first groove. The lower end of the second longitudinal rod disengages from the second groove. The first and second longitudinal rods are rotated until the lower end of the first longitudinal rod is inserted in the first groove and the lower end of the second longitudinal rod is inserted in the second groove.

DETAILED DESCRIPTION OF THE INVENTION

Figure 1:
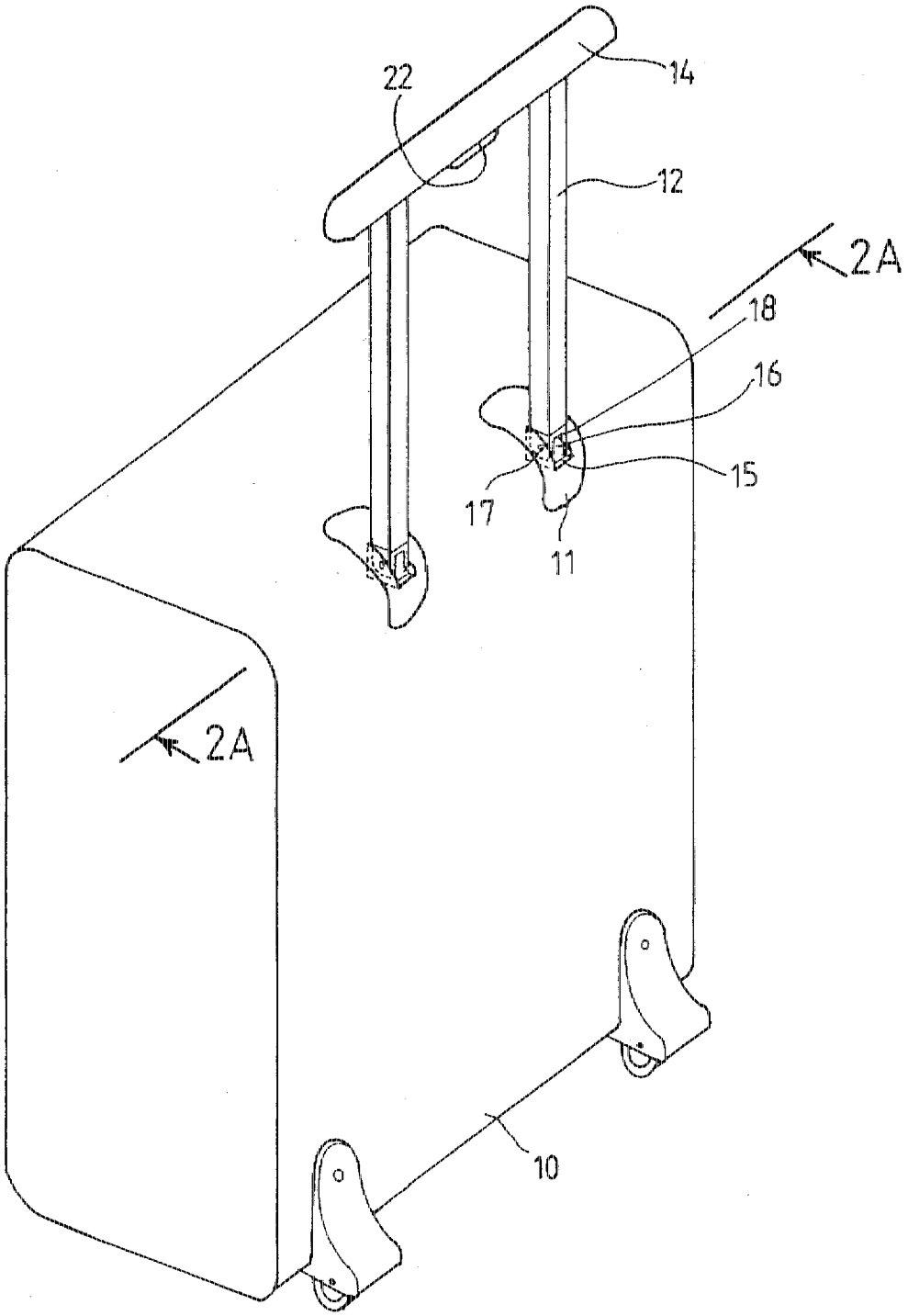
FIG. 1 is a perspective view of a rotatable handle device of a preferred embodiment disposed in a suitcase.
Figure 2:
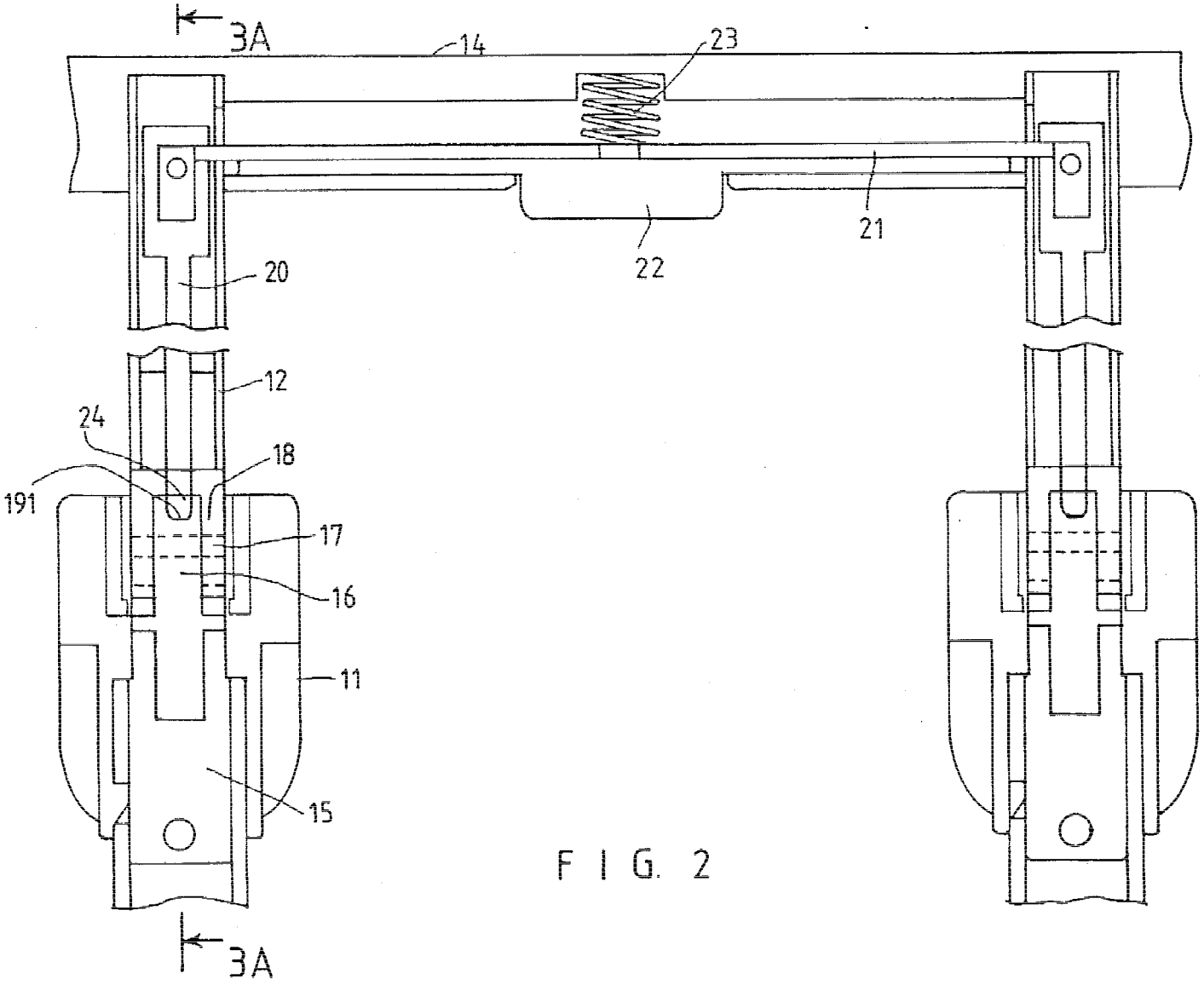
FIG. 2 is a sectional view taken along line 2A—2A in FIG. 1.
Figure 3:
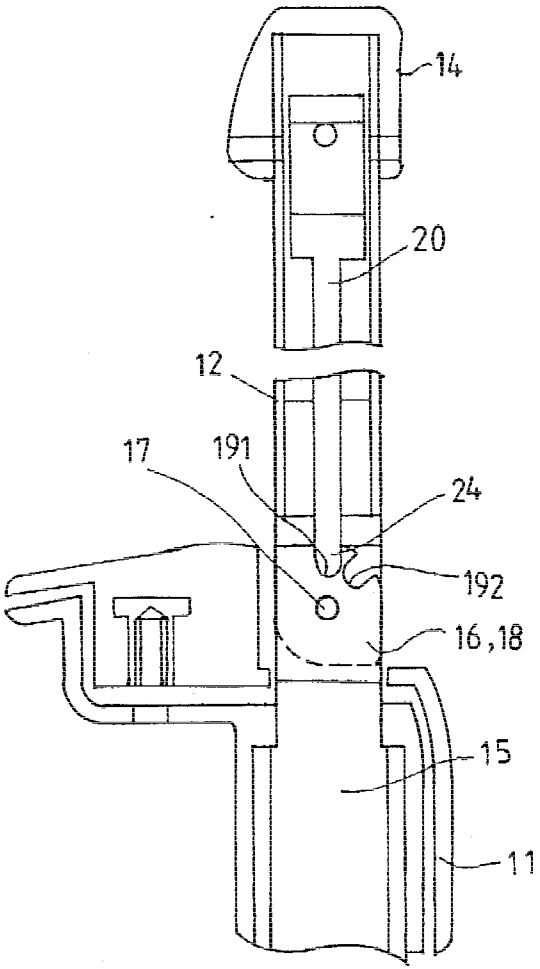

Referring to FIGS. 1 to 3, a suitcase 10 has a first and second hollow fixed frames 11 disposed on a top of the suitcase 10. A rotatable handle device comprises a handle 14, a first and second elongated arms 12 extending downward from the handle 14, a first slide seat 15 disposed in the first hollow fixed frame 11, and a second slide seat 15 disposed in the second hollow fixed frame 11. A first protruded block 16 is disposed on an upper portion of the first slide seat 15. A second protruded block 16 is disposed on an upper portion of the second slide seat 15. A first pair of fins 18 are disposed on a lower end of the first elongated arm 12 to enclose an upper portion of the first slide seat 15. The first pair of fins 18 and the first protruded block 16 are fastened by a first pivot pin 17. A second pair of fins 18 are disposed on a lower end of the second elongated arm 12 to enclose an upper portion of the second slide seat 15. The second pair of fins 18 and the second protruded block 16 are fastened by a second pivot pin 17. At least a pair of first grooves 191 and 192 are formed on the first protruded block 16. At least a pair of second grooves 191 and 192 are formed on the second protruded block 16. A first longitudinal rod 20 is inserted in the first elongated arm 12. A second longitudinal rod 20 is inserted in the second elongated arm 12. A transverse rod 21 is disposed under the handle 14. A first end of the transverse rod 21 is connected to an upper end of the first longitudinal rod 20. A second end of the transverse rod 21 is connected to an upper end of the second longitudinal rod 20. A spring 23 is disposed between the handle 14 and the transverse rod 21. A push button 22 is disposed on the transverse rod 21 to contact the spring 23. A lower end 24 of the first longitudinal rod 20 is inserted in one of the first groove 191 or 192. A lower end 24 of the second longitudinal rod 20 is inserted in one of the second groove 191 or 192.

Referring to FIGS. 2 and 3 again, the spring 23 presses the transverse rod 21 downward. The first longitudinal rod 20 is driven downward so that the lower end 24 of the first longitudinal rod 20 is inserted in the first groove 191. The second longitudinal rod 20 is driven downward so that the lower end 24 of the second longitudinal rod 20 is inserted in the second groove 191.

Figure 4:
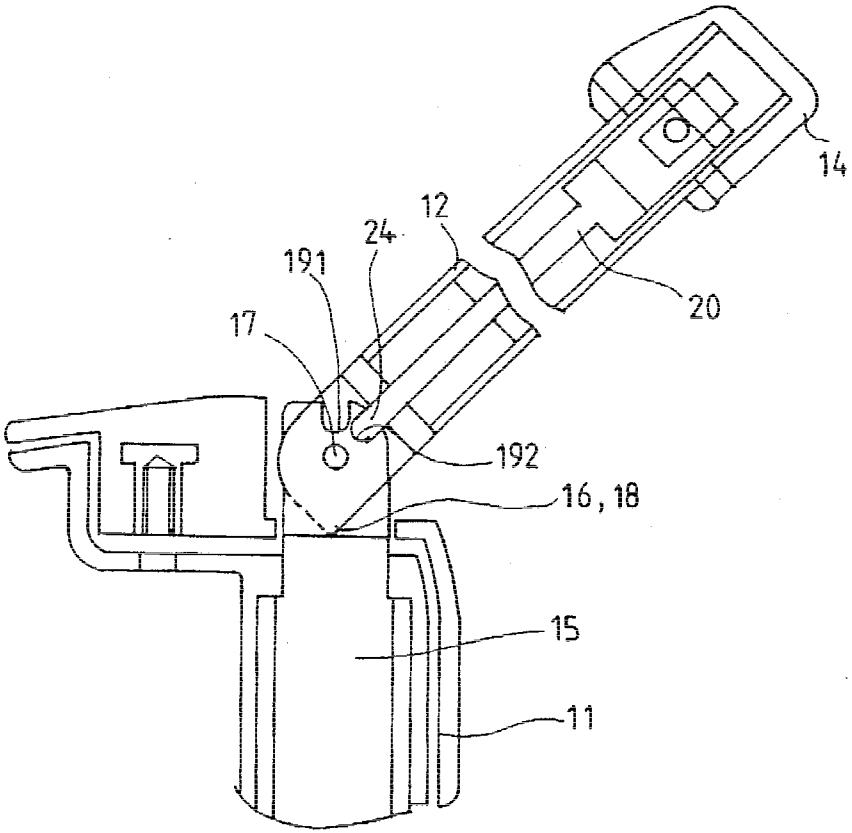
FIGS. 3 and 4 are sectional schematic views taken along line 3A—3A in FIG. 2 illustrating the operation of the rotatable handle device.
Figure 5:
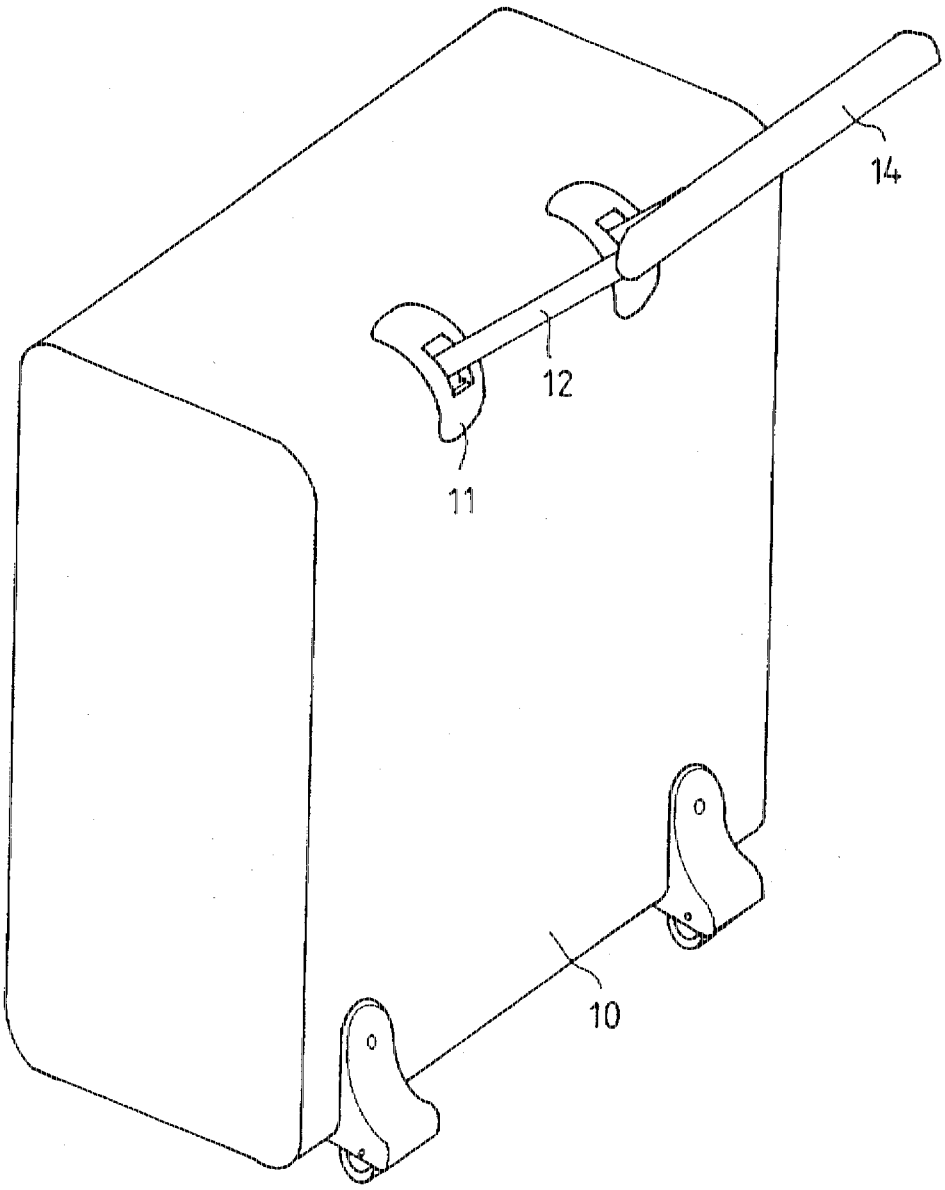
FIG. 5 is a perspective schematic view illustrating the operation of the rotatable handle device.

Referring to FIGS. 4 and 5, the push button 22 is pressed upward so that the first and second longitudinal rods 20 are driven upward. The lower end 24 of the first longitudinal rod 20 disengages from the first groove 191. The lower end 24 of the second longitudinal rod 20 disengages from the second groove 191. The first and second longitudinal rods 20 are rotated until the lower end 24 of the first longitudinal rod 20 is inserted in the first groove 192 and the lower end 24 of the second longitudinal rod 20 is inserted in the second groove 192.

It is an option to provide a first inserted recess on the lower end of the first longitudinal rod 20 and a second inserted recess on the lower and of the second longitudinal rod. A first compressed spring is inserted in the first inserted recess. A second compressed spring is inserted in the second inserted recess.

The invention is not limited to the above embodiment but various modification thereof may be made. It will be understood by those skilled in the art that various changes in form and detail may be made without departing from the spirit and scope of the invention.

I claim:

1. A suitcase comprising:

a first and second hollow fixed frames disposed on a top of the suitcase, a rotatable handle device having a handle, a first and second elongated arms extending downward from the handle, a first slide seat disposed in the first hollow fixed frame, and a second slide seat disposed in the second hollow fixed frame, a first protruded block disposed on an upper portion of the first slide seat, a second protruded block disposed on an upper portion of the second slide seat, a first pair of fins disposed on a lower end of the first elongated arm to enclose an upper portion of the first slide seat, the first pair of fins and the first protruded block fastened by a first pivot pin, a second pair of fins disposed on a lower end of the second elongated arm to enclose an upper portion of the second slide seat, the second pair of fins and the second protruded block fastened by a second pivot pin, at least a pair of first grooves formed on the first protruded block, at least a pair of second grooves formed on the second protruded block, a first longitudinal rod inserted in the first elongated arm, a second longitudinal rod inserted in the second elongated arm, a transverse rod disposed under the handle, a first end of the transverse rod connected to an upper end of the first longitudinal rod, a second end of the transverse rod connected to an upper end of the second longitudinal rod, an elastic element disposed between the handle and the transverse rod, a push button disposed on the transverse rod to contact the elastic element, a lower end of the first longitudinal rod inserted in one of the first groove, and a lower end of the second longitudinal rod inserted in one of the first groove.

2. A suitcase as claimed in claim 1, wherein said elastic element is a spring.

3. A suitcase as claimed in claim 1, wherein a first inserted recess is formed on the lower end of the first longitudinal rod.

4. A suitcase as claimed in claim 1, wherein a second inserted recess is formed on the lower end of the second longitudinal rod.

5. A suitcase as claimed in claim 3, wherein a first compressed spring is inserted in the first inserted recess.

6. A suitcase as claimed in claim 4, wherein a second compressed spring is inserted in the second inserted recess.

* * * * *